United States Patent [19]

Wolff

[11] 4,009,536

[45] Mar. 1, 1977

[54] TRIGGER MECHANISM FOR FIREARMS

[75] Inventor: Horst Wolff, Weilstetten, Germany

[73] Assignee: Carl Walther Sportwaffenfabrik, Ulm (Danube), Germany

[22] Filed: Jan. 29, 1975

[21] Appl. No.: 544,971

[30] Foreign Application Priority Data

Jan. 29, 1974 Germany ..... 2404053

[52] U.S. Cl. ..... 42/84; 89/135

[51] Int. Cl.[2] ..... F41C 19/12

[58] Field of Search ..... 42/84, 69 R, 69 A; 89/28 A, 135; 124/11 R, 13 A

[56] References Cited

UNITED STATES PATENTS

| | | | |
|---|---|---|---|
| 1,170,363 | 2/1916 | Taylor | 42/69 R |
| 1,540,494 | 6/1925 | Olszowiec | 42/84 |
| 1,844,865 | 2/1932 | Schladt | 42/84 |
| 1,987,912 | 1/1935 | Rady et al. | 42/84 |
| 2,780,882 | 2/1957 | Temple | 42/84 |
| 3,241,445 | 3/1966 | Zehfeld et al. | 89/135 |
| 3,250,034 | 5/1966 | Simmons | 42/84 |
| 3,626,624 | 12/1971 | Green | 42/84 |
| 3,650,174 | 3/1972 | Nelsen | 42/84 |
| 3,703,845 | 11/1972 | Griew | 89/135 |

*Primary Examiner*—Charles T. Jordan
*Attorney, Agent, or Firm*—Edmund M. Jaskiewicz

[57] ABSTRACT

A trigger mechanism for firing a firearm comprises an electromagnet including a coil and a movable armature actuated by the coil. The armature is connected to the firing pin so as to move the firing pin when the coil is energized by actuating switch means which connects the coil to a source of electrical energy. The switch means is actuated by a trigger lever or button which closes a normally open switch.

19 Claims, 13 Drawing Figures

Fig. 1
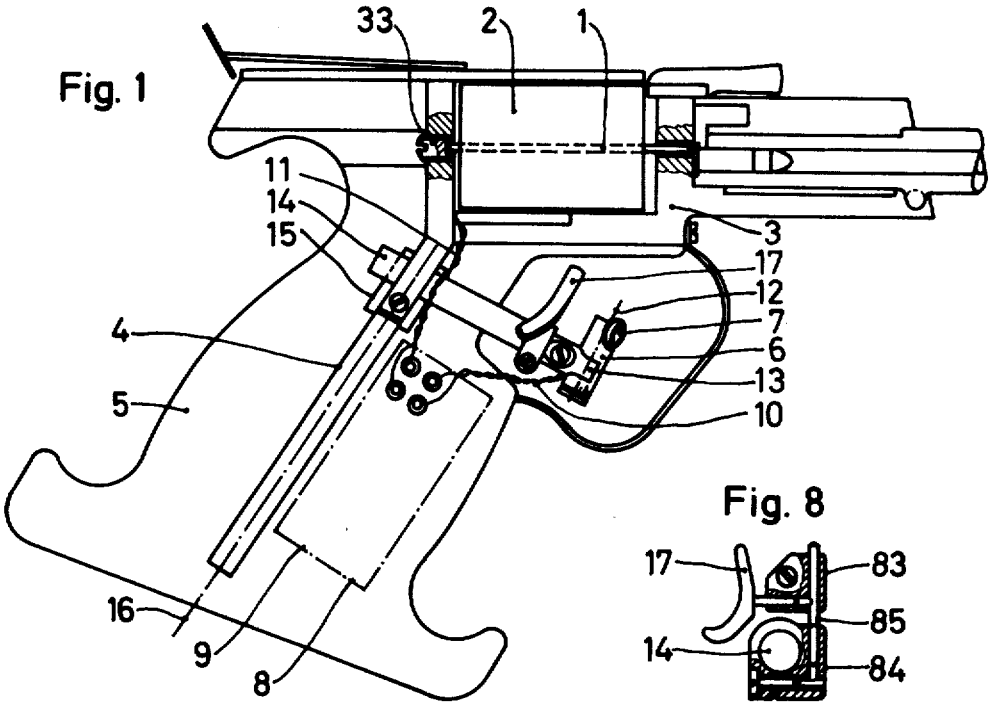
Fig. 8
Fig. 7
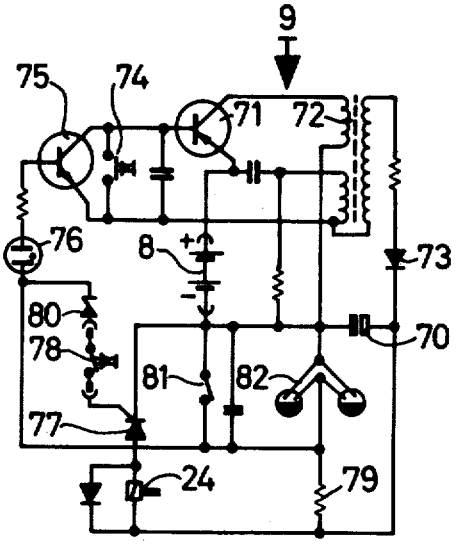
Fig. 9
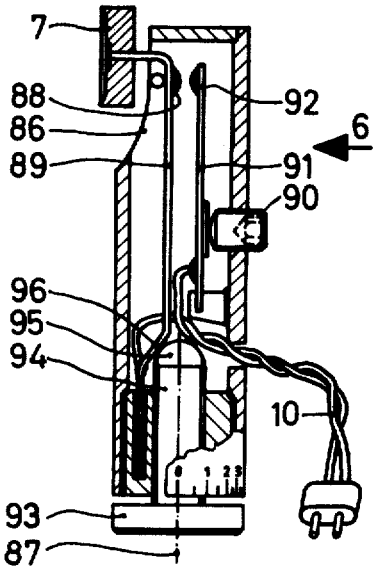

TRIGGER MECHANISM FOR FIREARMS

The present invention relates to a trigger mechanism for firearms, more particularly, to electromagnetically actuating a firing pin from a rest position into a firing position.

In order to obtain the best accuracy when using firearms for sporting purposes, the mechanism for firing the firearm should have a minimal time lapse between the actuation of the trigger and the instant when the firing pin reaches the firing position. In addition, the trigger should operate with great precision free of any vibrations and with results which can be repeated. The trigger should also meet various particular requirements of sportsmen with respect to firing positions, direction of firing, distance to the target, and resistance offered by the trigger. In addition, the firing mechanism should be relatively inexpensive to manufacture, have a minimal incidence of defects and require a minimum of servicing and maintenance during operation. In the cocked position, the firing mechanism should be as safe as possible with respect to the possibility of being actuated by impact, shock or vibration. All of the foregoing requirements apply both for firearms requiring high to average trigger pull and are particularly applicable to firearms used by marksmen and which have hair-trigger mechanisms which require a very light pull.

The conventional firing mechanism for a firearm has a firing pin that is actuated by a spring and a trigger mechanism which comprises a relatively complex assembly of mechanical components including levers.

Such known firing mechanisms have an operational time of more than 1ms elapsing between actuation of the trigger and the firing pin reaching its firing position. In addition, the continuous variation of the trigger pull caused by different lubricating conditions, the presence of dirt and dust and powder particles, mechanical wear, the distortion of mechanical components in response to temperature changes all contribute to decreasing the accuracy of the firearm. In addition, known firing mechanisms are characterized by being expensive to manufacture, susceptible of failure in operation, and requiring almost constant servicing when in operation. Because of the complex lever systems employed, the triggers of known firing mechanisms are capable of only limited adjustment to adapt to the habits of the user of the firearm. In addition, in such firing mechanisms upon release of a hair-trigger the trigger finger will drop a certain distance to the trigger guide after a relatively long travel of the trigger. This also contributes to reducing the reliability of the firearm in hitting a target.

In an attempt to improve known firing mechanisms, electromagnetic firing mechanisms have been proposed, such as disclosed in the German Pat. No. 206262. In such a mechanism the firing pin is moved forwardly in response to an electromagnet having a moving armature. However, in such firing mechanisms the firing pins are moved entirely by firing pin springs and are merely released upon energization of the electromagnet. Such devices have not proposed or even suggested the use of a displaceable armature of an electromagnet as the actuating means for the firing pin.

It is therefore the principal object of the present invention to provide a novel and improved firing mechanism for firearms.

It is another object of the present invention to provide a trigger mechanism for firearms utilizing an electromagnet.

It is a further object of the present invention to provide a trigger mechanism for firearms which improves the accuracy of the firearm by providing for a shorter operational time and by having improved trigger action and which at the same time is less expensive to manufacture and requires less servicing and maintenance than known mechanical trigger mechanisms.

According to one aspect of the present invention, a trigger mechanism for firearms comprises an electromagnet having a coil and a movable armature actuated by the coil with the armature being drivingly connected to the firing pin so as to move the firing pin when the coil is energized. Switch means are provided for connecting the coil to a source of electrical energy to energize the coil.

Other objects and advantages of the present invention will be apparent upon reference to the accompanying description when taken in conjunction with the following drawings, which are exemplary, wherein;

FIG. 1 is a side elevational view of a firearm of the pistol type with portions thereof being in section;

Figure 4A:
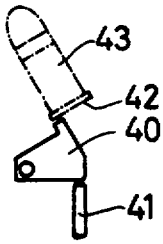
Figure 4B:
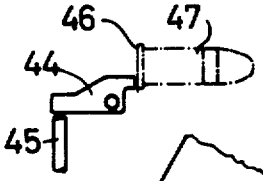
Figure 5:
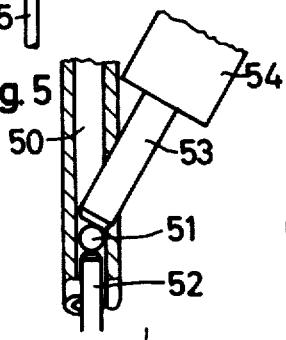
Figure 6:
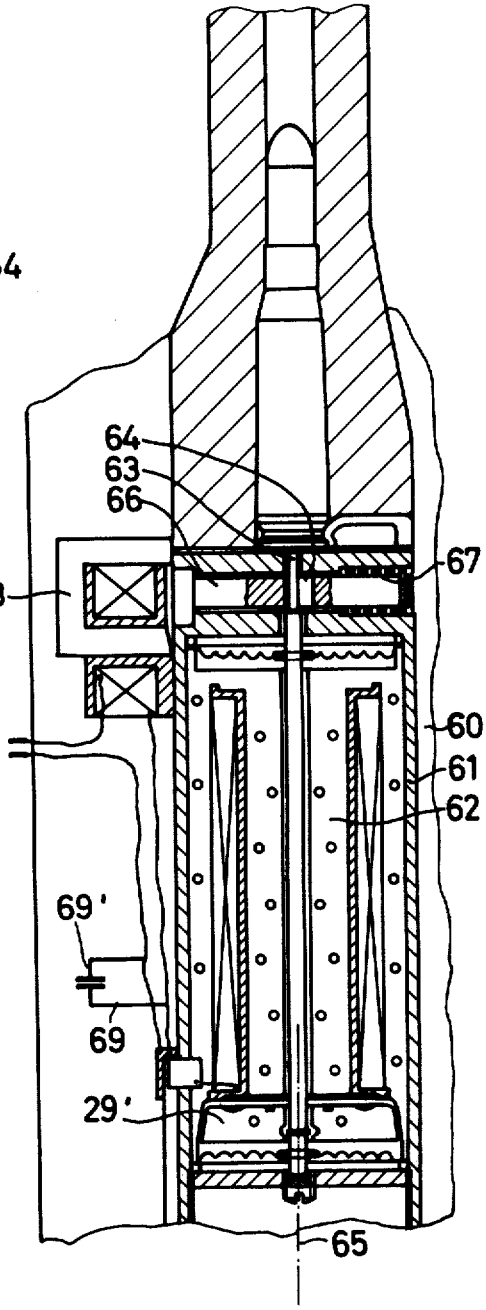
Figure 12:
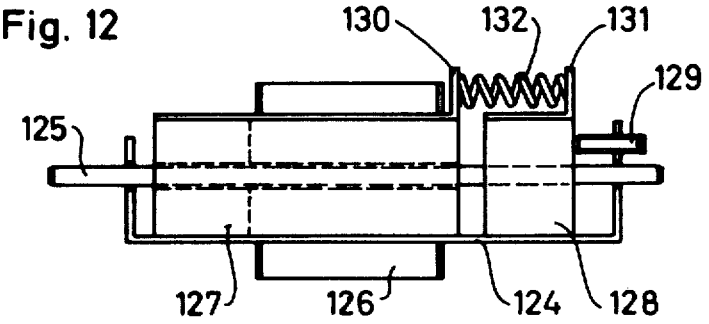
Figure 10:
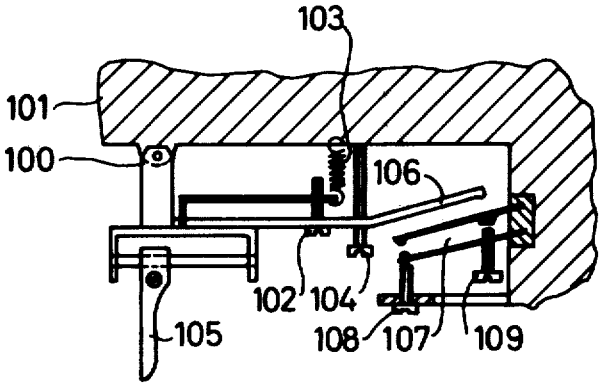
Figure 11:
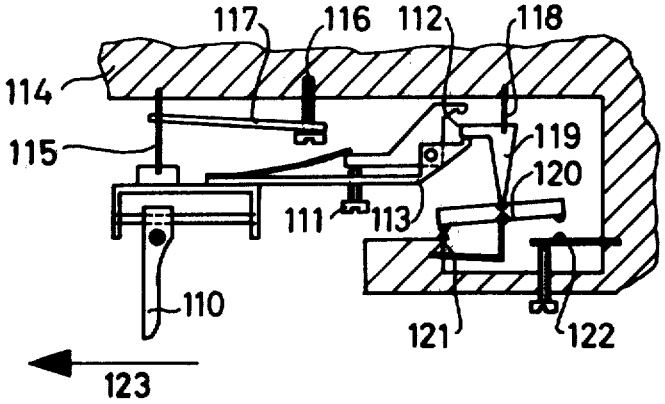

FIGS. 4*a* and 4*b* are elevational views of modifications of striking levers according to the present invention;

FIG. 5 is a longitudinal sectional view through a connection between an end of a firing pin and an end of a valve stem of an air gun;

FIG. 6 is a longitudinal sectional view through a portion of an automatic firearm incorporating the electromagnetic unlocking device according to the present invention;

FIG. 7 is a schematic circuit diagram of an electronic device for charging the storage capacitor, triggering the shot and locking the firearm;

FIG. 8 is a front elevational view, partially in section, of the trigger device and finger rest;

FIG. 9 is a longitudinal view through a container enclosing the switch of the trigger mechanism of the present invention;

FIGS. 10 and 11 are longitudinal sectional views through different trigger mechanisms having higher trigger pull or resistance according to the present invention; and FIG. 12 is an elevational view of an electromagnet having a movable armature and a firing pin in an open mounting.

Proceeding next to the drawings where like reference symbols indicate the same parts throughout the various views a specific embodiment and modifications of the present invention will be described in detail.

In FIG. 1 there is illustrated a pistol incorporating the present invention wherein a firing pin 1 is a component of its actuating means 2 which includes an electromagnet comprising a movable armature. Several modifications of the actuating means 2 are illustrated in further detail in FIGS. 2 and 12.

The firing pin actuator 2 is mounted on a frame 3, 4 of the pistol and a trigger mechanism which is shown in greater detail in FIG. 9 is mounted on frame portion 4 which extends into the firearm handle 5. The trigger mechanism is housed within a cylindrical container 6 and includes a trigger switch that is operated by means of a trigger button 7 which projects from an opening in the cylindrical wall of the container adjacent one end thereof. An electronic circuit 9 which is shown in FIG. 7 is located in the handle 5 together with a battery 8 which supplies the circuit with electric current. The circuit 9 is connected to the trigger switch by means of a cable 10 having a plug and is connected to the electromagnet of the actuator 2 by means of a plug-in cable 11.

The cylindrical container 6 is fixedly mounted on a clamp 13 in which the position of the container 6 can be adjusted longitudinally or pivoted with respect to the longitudinal axis 12 of the container 6. The clamp 13 is provided with a shaft 14 which is perpendicular to the axis 12 of the container 6 and the shaft 14 is fixed in a further clamp 15 so that the shaft is displaceable longitudinally and can be pivoted about its own longitudinal axis. The clamp 15 is mounted on frame 4 of the firearm and can be displaced longitudinally and pivoted with respect to the central longitudinal axis of the handle 5 indicated at 16.

The trigger mechanism can thus be adjusted to any desired position and pivoted to any desired angle within the possible range of the trigger finger of the user located in the firing position. A trigger contact or rest 17 which is shown in FIG. 8 is also mounted on the shaft 14.

Figure 2:
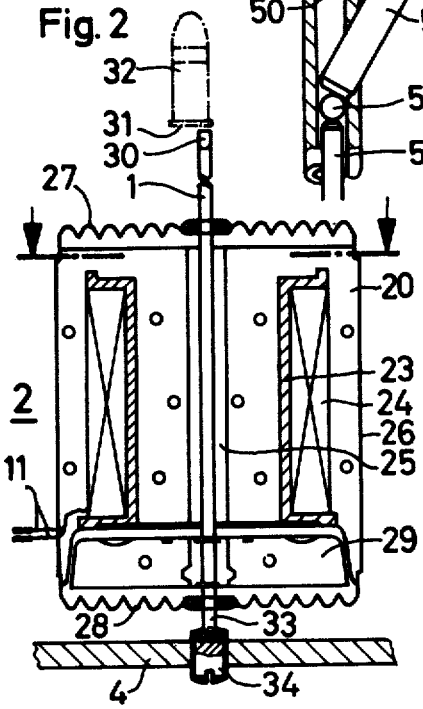
FIG. 2 is a longitudinal sectional view through the electromagnet utilized in FIG. 1 and showing the movable armature and firing pin.
Figure 3:
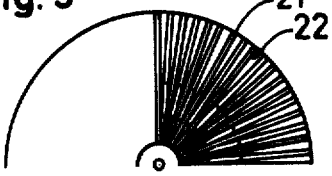
FIG. 3 is an end view of one-half of the coil of FIG. 2 with the left side comprising an elevational view and the right side comprising a section.

The firing pin actuator 2 shown in FIGS. 2 and 3 comprises a cylindrical shielded magnet having an axially symmetrical magnet element 20 which is E-shaped in longitudinal section and comprises a plurality of radially positioned magnetizable sheet metal plates 21 and the spaces 22 between the plates 21 are filled with a synthetic resin to which a magnetizable ferrite powder is added as a filler. A coil 24 is wound on a coil former 23 with the ends of the coil being connected to the plug-in cable 11. The magnet element 20 has a symmetrical longitudinal bore 25 in which is disposed the firing pin 1. The magnet element 20 is enclosed by a cylindrical jacket or casing 26, the ends of which are closed by two flexible diaphragms 27, 28 so as to form with the casing 26 an airtight container enclosing the magnet element 20. The firing pin 1 is mounted on the diaphragms 27 and 28. One end of the casing 26 projects beyond an end of the magnet element 20 and within this extension there is disposed a movable armature 29 having the shape of a disc similarly consisting of a plurality of plates and enclosed within the airtight container formed by the diaphragms 27, 28 and the casing 26. When the firing pin is moved into the firing position its front end 30 will strike against a bottom 31 of a rim fire cartridge 32 inserted in the cartridge chamber of the firearm. In its rest position, a rear end 33 of the firing pin 1 contacts a setting screw 34 on the frame of the firearm so that the setting screw determines the rest position.

The symmetry of the armature about an axis parallel to its direction of movement avoids any adverse effects which might be caused by the actuator in the direction of shooting. Mounting of the firing pin along the axis of symmetry of the armature enables one to obtain a low mass and maximum velocity actuator for the firing pin. Enclosing the magnet and the bore therein in which the firing pin is disposed with an airtight casing provides an actuator whose operation will not be hindered in any way by powder particles, lubricants or any dirt or foreign matter. Further, the firing pin actuator can be readily installed and replaced.

By providing a striking lever 40 as shown in FIG. 4a it is possible to guide the impact of a firing pin 41 against the bottom 42 of a rim fire cartridge 43 at an angle of about 45 degrees. A striking lever 44, such as shown in FIG. 4b, makes it possible to guide the impact of a firing pin 45 against a bottom 46 of a rim fire cartridge 47 at an angle of about 90 degrees.

When the firearm comprises an air gun, a bore 51 guided in a duct or passage 50 couples the end of a firing pin 52 located in the duct 50 with the end of a valve stem 53 of a valve 54 of the air gun. The valve stem 53 projects obliquely into the duct 50 and the presence of the ball 51 enables the direction of impact of the firing pin to be delivered at an angle with respect to the movement of the firing pin.

For an automatic firearm, a portion of which is shown in FIG. 6, an actuator mechanism 62 for the firing pin is located in a bolt 61 which is guided in a bolt chamber 60. The actuator mechanism corresponds substantially to the actuator mechanism illustrated in FIG. 2 and described above. The firing pin has a front end 63 which is of a smaller diameter than the remaining portion of the firing pin and traverses a lower portion of a bore 64 in a movable armature 66 of the actuator mechanism. The armature 66 is displaceably mounted in the front portion of bolt 61 for movement transversely to the longitudinal axis 65 of the firing pin. The lower portion of the bore 64 is adapted to the reduced diameter of the front end 63 of the firing pin. The movable armature 66 is held in the illustrated lock position by a compression spring 67 and can be moved into an unlocked position upon energization of an electromagnet 68 mounted on the bolt chamber 60. In the unlocked position, a widened right-hand portion of the bore 64 which is adapted to the major diameter of the firing pin permits free movement of the firing pin therethrough. The coils of actuator mechanism 62 and electromagnet 68 can be connected in series and operated concurrently since a movable armature 29' of the actuator mechanism 62 is delayed in response to the movable armature 66 of the unlocking device by a substantially larger dimension of its mass or by connecting a substantially capacitive two pole element 69' in parallel with its coil.

The electronic circuit 9, shown in FIG. 7, employed for operating the firing mechanism includes a voltage transformer circuit which charges a capacitor 70 and includes an oscillating transistor 71, a transformer 72 having operating, feedback and high voltage windings, a high voltage rectifier 73 and the battery 8 which supplies the operating voltage. The voltage transformer circuit, which is ordinarily blocked, is switched on by closing a non-lockable starting switch 74 which can again by released subsequently in response to a holding circuit. The holding circuit includes a transistor 75 whose emitter-collector path bridges over the starting switch 74 as soon as the voltage on capacitor 70 is sufficient for lighting a glow lamp 76 connected to the base of transistor 75 and located in a position on the firearm so as to be readily visible to the user.

The capacitor 70 which can be charged to about 300 volts, together with a low resistance winding 24 of the order of 10 ohms of the electromagnet and a thyristor 77 which acts like a controllable electric switch, forms an impulse discharge circuit which can be closed by supplying an ignition current to the ignition electrode of thyristor 77. The ignition circuit leads from one terminal of the capacitor 70 through a compensating resistance 79, a Zener diode 80 and a switch 78 to the ignition electrode of thyristor 77 whose cathode is connected to the other terminal of the capacitor 70.

A discharge circuit employed for locking the firearm leads from a terminal of capacitor 70 through the series resistance 79 and a manually operable discharge switch 81 or through a position responsive mercury discharge switch 82 connected in parallel thereto to the other terminal of storage capacitor 70.

The impulse discharge circuit provides for the fastest possible response of the actuator and enables the trigger mechanism disposed herein to have operational times of 0.5 ms and less. At the same time, the impulse discharge circuit is a relatively simple circuit which is reliable in operation.

The connecting of the discharge switch together with the series resistance to the other terminal of the storage capacitor enables an unlocked weapon which is ready for firing to be locked either arbitrarily by hand and/or automatically when it is put down. The Zener diode has a voltage which is greater than the threshold voltage operating the holding circuit means so as to prevent a premature firing of a shot when the storage capacitor is not sufficiently charged.

The finger contact or rest 17 shown in FIG. 8 is attached to shaft 14 of the trigger mechanism and can be positioned as desired in the space between the two clamps 13 and 14 by means of two additional clamps 83 and 84 and a further shaft 85 which interconnects the clamps 83 and 84.

The container 6 of the trigger mechanism as shown in FIG. 9 consists of a cylindrical tube, both ends of which are closed, and in the cylindrical wall there is an opening 86 adjacent an end thereof. The trigger button 7 is mounted on the bent end of a leaf spring 89 which projects radially through the opening 86 with respect to the central longitudinal axis 87 of the tubular container 6. Also on the leaf spring 89 is a contact 88 which forms one pole of the trigger switch 78. In the wall of the container 6 and opposite from but facing in the same direction as the button 7 is an adjusting screw 90, the end of which engages a leaf spring 91 on the end of which is a contact 92 engageable with contact 88. An adjusting screw 94 is axially mounted in the lower end of the container 6 as viewed in FIG. 9 and is attached to an adjusting disc 93 positioned at the end of the container 6. The inner end of the adjusting screw 94 is rounded as shown at 95 and is engageable with a bent portion 96 of the leaf spring 89. Adjusting of the disc 93 will thus adjust the contact resistance and adjusting of the screw 90 will establish the distance through which the contact 88 must be moved in order to engage the contact 92.

In FIG. 10 there is illustrated a trigger mechanism which is intended for firearms having average to high trigger pull and comprises a substantially rectangular angular lever having a shorter arm 105 and a longer arm 106. The lever is provided with a projection 100 which is pivotally mounted to the frame 101 of the firearm and is pivotable against the force of a spring 103 adjustable by means of a screw 102 within an angular range adjustable by means of a screw 104. The shorter arm 105 functions as the trigger and the longer arm 106 extends approximately parallel with the barrel of the firearm, which is not shown in the drawing. The end of the longer lever arm 106 operates a switch 107 comprising a pair of leaf spring contacts, the contact distance of which can be adjusted by means of an adjusting screw 108 and whose end position can be determined by means of an adjusting screw 109.

In FIG. 11 there is illustrated a trigger mechanism having a pivotally mounted crank lever with a shorter lever arm 110 that forms the trigger and a longer lever arm 113 on the end of which is a jaw 112 adjustable by means of a setting screw 111. The crank lever is pivotally mounted to a frame 114 of a firearm by means of a leaf spring 115 whose trigger pull determining initial tension can be set by means of an adjusting screw 116 mounted on the end of a lever 117 extending from the leaf spring 115. During forward shifting and backward pulling of the trigger 110, the jaw 112 will operate in the opposite manner a rectangular control lever 119 pivotally mounted to firearm frame 114 by a leaf spring 118 and associated with a stop-action switch having two stable positions. The control lever 119 is engagable with a switching lever 120 which in each position closes with one of the contacts 121 and 122. The contact 122 forms one side of the trigger switch 78 of FIG. 7 and is closed when the trigger 110 is pulled in the direction indicated in the arrow 123. When the trigger 110 is operated in a direction opposite to the arrow 123 the contact 121 will be closed which forms one side of the starting switch 74 of FIG. 7.

In FIG. 12 there is shown a modification of the firing mechanism wherein the electromagnet is located in an open position with respect to the firearm. The electromagnet comprises an E-core 127 having a winding 126 and threadedly mounted on a bracket 124 whose ends are bent upwardly to form bearings for receiving a firing pin 125. An I-shaped yoke 128 functions as the moving armature and is securely attached to the rear end of the firing pin 125 and guided unilaterally by the bearing bracket 124. An adjusting set screw 129 in the rear end portion of the bracket 124 is used to set the rest position of firing pin 125 in which position it is retained by means of a compression spring 132 which acts between angular elements 130 and 131 mounted respectively on the core 127 and the yoke 128. The open structure of this firing mechanism modification is again characterized by its extreme simplicity.

Thus it can be seen that the firing mechanism of the present invention has a number of advantages which include that the actuator for the firing pin does not require a spring, the actuator responds very quickly, the actuator generates a high striking impact within an extremely short travel of the firing pin and is not sensitive to vibrations or impact when in the position ready for firing. In addition, the firing mechanism is protected from dirt and other foreign matter by an extremely simple structure, is inexpensive to manufacture and its striking force can be adapted to the requirements of dry run training by reducing the size of the capacitor or by reducing the travel of the firing pin. Further, the striking force of the firing pin can be readily adjusted. The trigger can be moved entirely free of any vibration, can be readily adjusted and its characteristics can be obtained repeatedly while at the same time the trigger can be adapted in many ways to the shooting habits of a particular marksman. The trigger mechanism can be inexpensively produced and can be set to particularly short trigger travel and minimal trigger pull which will not fluctuate but remain constant. The electronic arrangement for actuating the firing mechanism is compact in size, light in weight, inexpensive to manufacture, reliable in operation, insensitive to the effects of the environment and offers many possibilities of incorporating many safety features in the firearm, some of which have been discussed above.

By providing a two-position snap action switch in conjunction with the trigger, the necessity of providing a separate starting switch for charging the storage capacitor is eliminated.

It will be understood that this invention is susceptible to modification in order to adapt it to different usages and conditions, and accordingly, it is desired to comprehend such modifications within this invention as may fall within the scope of appended claims.

What is claimed is:

1. A trigger mechanism for firearms comprising a movable firing pin, an electromagnet having a coil and a movable armature actuated by said coil, said coil being cylindrical and comprising an outer surface element around said coil and extending beyond one end thereof, said armature being disc-shaped and disposed within said surface element extension, a pair of diaphragms on the ends of said surface element to close said coil and carrying said firing pin at the centers thereof, said armature drivingly connected to said firing pin to move the same when said coil is energized, and switch means for connecting said coil to a souce of electrical energy to energize said coil.

2. A trigger mechanism as claimed in claim 1 and a pivotally mounted lever engageable by said firing pin and acting upon an object when struck by said firing pin.

3. A trigger mechanism as claimed in claim 1 and means for rapidly energizing said trigger mechanism electromagnet.

4. A trigger mechanism as claimed in claim 3 wherein said trigger mechanism coil has a low ohmic resistance, said electrical energy source comprises a high voltage capacitor and a thyristor connected to said coil to define an impulse discharge circuit fired by said switch means.

5. A trigger mechanism as claimed in claim 4 and electrical battery means and a normally open starter switch connected to said capacitor so that closing of said starting switch connects said capacitor to said battery means, and holding circuit means connected across said starting switch and energized when the charging threshold voltage of the capacitor is exceeded to maintain said capacitor in the undischarged state.

6. A trigger mechanism as claimed in claim 5 and an electrical resistance and a Zener diode connected in series with said switch means to define a firing circuit for said thyristor, the Zener voltage of said diode being greater than the threshold voltage operating said holding circuit means.

7. A trigger mechanism as claimed in claim 5 and discharge switch means which together with said electrical resistance are connected in parallel with said capacitor.

8. A trigger mechanism as claimed in claim 1 and comprising an angular lever having a shorter and a longer arm and pivotally mounted on the frame of the firearm, means for adjusting the pivot range of said lever, spring means acting against said lever to retain the lever in a normal position, said shorter lever arm defining a trigger and said longer lever arm extending substantially parallel to a barrel of the firearm and engageable with said switch means to actuate the same.

9. A trigger mechanism as claimed in claim 8 wherein said switch means comprises a pair of leaf spring contacts and means for adjusting the distance between said contacts and for adjusting the end position thereof.

10. A trigger mechanism as claimed in claim 8 wherein said switch means comprises a snap-action switch.

11. A trigger mechanism as claimed in claim 10 wherein said electrical energy source comprises a high voltage capacitor and a thyristor connected to said coil to define an impulse discharge circuit fired by said switch means, electrical battery means and a normally open starter switch connected to said capacitor so that closing of said starting switch connects said capacitor to said battery means, holding circuit means connected across said starting switch and energized when the starting threshold-voltage of the capacitor is exceeded to maintain said capacitor in the undischarged state, said snap-action switch having two positions and a first contact for one position and a second contact for the other position, said first contact connected to said starting switch and said second contact connected to said switch means.

12. A trigger mechanism for firearms comprising a movable firing pin, an electromagnet having a coil and a movable armature actuated by said coil, said armature drivingly connected to said firing pin to move the same when said coil is energized, switch means for connecting said coil to a source of electrical energy to energize said coil, electromagnetic means in a bolt of a firearm for unlocking said firing pin, said unlocking means comprising a coil and a second armature movable in a direction perpendicular to the axis of the firing pin.

13. A trigger mechanism as claimed in claim 12 wherein said movable second armature is on the bolt and said coil is in a bolt chamber of the firearm.

14. A trigger mechanism as claimed in claim 12 wherein said unlocking means coil and said trigger mechanism coil are connected in series, and means for delaying the response of said trigger mechanism armature with respect to the response of said unlocking means armature so that said firing pin will be actuated after it has been unlocked.

15. A trigger mechanism for firearms comprising a movable firing pin, an electromagnet having a coil and a movable armature actuated by said coil, said armature drivingly connected to said firing pin to move the same when said coil is energized, switch means for connecting said coil to a source of electrical energy to energize said coil, a casing containing said switch means and having an externally accessible trigger button, said casing being positioned on said firearm in a vertical plane in which lies the longitudinal axis of a firearm handle within the range of a trigger-actuating finger in the firing position, and means for mounting said casing for adjustment in two mutually perpendicular axes one of which is perpendicular to the operating direction of said trigger button.

16. A trigger mechanism as claimed in claim 15 wherein said casing is cylindrical, said mounting means comprising a clamp which is longitudinally displaceable and pivotable about the longitudinal axis of said cylindrical casing, and a shaft upon which said clamp is mounted and extending perpendicular to the longitudinal axis of said cylindrical casing and longitudinally displaceable and pivotable about its longitudinal axis.

17. A trigger mechanism as claimed in claim 16 and a holder on the frame of the firearm receiving said shaft and displaceable along and pivotable about said longitudinal axis of the firearm handle.

18. A trigger mechanism as claimed in claim 16 wherein said cylindrical casing is tubular and has an opening adjacent an end thereof, said trigger button projecting from said opening radially to the longitudinal axis of said tubular casing, a spring contact within said casing and carrying said trigger thereon, a second spring contact within said casing and engageable by said first spring contact, an adjusting screw in said casing engaging said second spring contact to adjust the position thereof with respect to said first contact, a second adjusting screw in said casing and movable axially of said casing to engage a bent portion on said first spring contact, and an operating disk at an end of said casing and attached to said second adjusting screw to actuate the same.

19. A trigger mechanism as claimed in claim 19 and a finger rest mounted between said first holder and a second holder and a shaft extending therefrom, and first and second holder clamps adjustably retaining said rest shaft.

* * * * *